US007558375B2

(12) United States Patent
Schaefer et al.

(10) Patent No.: US 7,558,375 B2
(45) Date of Patent: Jul. 7, 2009

(54) STATIONARY CATHODE IN ROTATING FRAME X-RAY TUBE

(75) Inventors: Thomas D. Schaefer, Brookfield, WI (US); Ron Kent Hockersmith, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 88 days.

(21) Appl. No.: 11/737,947

(22) Filed: Apr. 20, 2007

(65) Prior Publication Data

US 2008/0260105 A1 Oct. 23, 2008

(51) Int. Cl.

| | |
|---|---|
| ***H01J 35/20*** | (2006.01) |
| ***H01J 35/10*** | (2006.01) |
| ***H01J 35/12*** | (2006.01) |

(52) U.S. Cl. ..... 378/123; 378/132; 378/199

(58) Field of Classification Search ..... 378/119, 378/101, 123, 125, 132, 143, 144, 199, 200; 277/410, 59, 80, 71, 79

See application file for complete search history.

(56) References Cited

U.S. PATENT DOCUMENTS

| | | | | |
|---|---|---|---|---|
| 5,340,122 | A * | 8/1994 | Toboni et al. | 277/410 |
| 7,483,518 | B2 * | 1/2009 | Hamill | 378/144 |
| 2008/0080672 | A1 * | 4/2008 | Anno | 378/130 |
| 2008/0137811 | A1 * | 6/2008 | Gadre et al. | 378/123 |

* cited by examiner

*Primary Examiner*—Irakli Kiknadze
(74) *Attorney, Agent, or Firm*—Ziolkowski Patent Solutions Group, SC

(57) ABSTRACT

An x-ray tube includes a stationary base and a passage therein. The x-ray tube includes an anode frame having an anode positioned adjacent to a first end and having a neck at a second end, the neck extends into the passage, wherein the anode frame is configured to rotate about a longitudinal axis of the passage. A hermetic seal is positioned about the neck between the neck and the stationary base.

25 Claims, 5 Drawing Sheets

STATIONARY CATHODE IN ROTATING FRAME X-RAY TUBE

BACKGROUND OF THE INVENTION

The present invention relates generally to x-ray tubes and, more particularly, to a method of fabricating and an apparatus of a rotating frame x-ray tube having a stationary cathode radially offset from a center of rotation thereof, and having a target and cathode hermetically sealed from an ambient environment.

X-ray systems typically include an x-ray tube, a detector, and a rotating assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector converts received radiation to electrical signals, and the x-ray system translates the electrical signals into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes typically include a rotatable anode structure for distributing heat generated at a focal spot. The anode is typically rotated by an induction motor having a cylindrical rotor built into an axle that supports a disc-shaped anode target and having an iron stator structure with copper windings that surrounds the rotor. The rotor of the rotatable anode assembly is driven by the stator. An x-ray tube cathode provides a focused electron beam that is accelerated across a cathode-to-anode vacuum gap and produces x-rays upon impact with the anode. The anode and the cathode are typically positioned within a frame that encloses a vacuum, and the frame is typically positioned within a casing that contains a coolant such as oil.

When a conventional x-ray tube is positioned in a rotatable system, such as on a CT gantry, x-rays emitting from the focal spot typically emit from a point on the anode target that is positioned radially inward, or toward the object to be imaged. This is typically accomplished by positioning the cathode within the x-ray tube at a fixed position with respect to the frame. The frame, likewise, is typically mounted within the x-ray tube casing, which is in turn mounted to a rotatable base such as that in a CT gantry. Accordingly, as the x-ray tube of a conventional design rotates about the CT gantry, the cathode emits electrons toward the target from a fixed position with respect to the x-ray tube, thus fixing the x-ray emission point (i.e., the focal spot) as well, with respect to the rotating base. In this manner, the focal spot is positioned at a constant radial position within the CT system during operation.

Because of the high temperatures generated when the electron beam strikes the target, it is necessary to rotate the anode assembly at a high rotational speed. This places stringent demands on the bearing assembly, which typically includes tool steel ball bearings and tool steel raceways positioned within the vacuum region, thereby requiring the bearing assembly to be lubricated by a solid lubricant such as silver. The rotor, as well, is typically placed in the vacuum region of the x-ray tube. Wear of the lubricant and loss thereof from the bearing contact region increases acoustic noise and slows the rotor during operation. Placement of the bearing assembly in the vacuum region prevents lubricating with wet bearing lubricants, such as grease or oil, and prevents performing maintenance on the bearing assembly to replace the solid lubricant without intrusion into the vacuum region. In addition, the operating conditions of newer generation x-ray tubes have become increasingly aggressive in terms of stresses because of g forces imposed by higher gantry speeds and higher anode rotational speeds. As a result, there is greater emphasis in finding bearing solutions for improved performance under the more stringent operating conditions.

One known solution is to position the bearings outside the vacuum region to enable use of larger, grease or oil lubricated bearings. This may be accomplished by enclosing the cathode and the anode target within a sealed volume defined by a rotatable frame. Such designs are typically referred to as "rotating frame" x-ray tubes which typically position anode target as a stationary component with respect to the frame, and the cathode is typically positioned substantially at the center of rotation of the rotating frame x-ray tube. The frame is encased in an oil bath that serves as a cooling medium to remove heat radiated from the anode target within the vacuum region to the walls of the frame. The frame is caused to rotate at a high rate of speed within the bath to prevent excessive temperatures from occurring on the target at the point of electron impingement on the target. The action of the entire frame rotating in an oil bath results in a viscous load and high demand for power in order to obtain the necessary rotation velocities.

The cathode is typically positioned at the rotational center of the frame in order to provide an emission source that remains at a central location as the frame rotates. In order to impinge electrons on the target at a position of high relative velocity to avoid overheating the focal spot, the electrons must be directed toward an outward radial position on the target. Accordingly, the electrons emitting from the cathode must be directed to the outer radial position of the target by using magnetic deflection, electrostatic deflection, and the like. As the x-ray tube is caused to rotate about the object to be imaged in the CT system, and as the frame is caused to rotate within the casing, deflection of electrons toward the target is synchronized with the rotation of the x-ray tube about the CT system, thus the focal spot is positioned at a constant radial position, directed toward the object to be imaged, within the CT system during operation.

However, the deflection mechanism within a typical rotating frame x-ray tube is difficult to implement and adds considerable cost and complexity to a CT system. Not only must a deflection mechanism be implemented, but its operation must be synchronized with rotation of the x-ray tube on the system. Furthermore, the amount of beam deflection may be limited as well. To deflect the beam an increased distance from the center-located cathode, greater electrostatic or magnetic field strength is required. Thus, a tradeoff is made between the focal spot radial position on the target that has a focal track temperature and the amount of field or electrostatic strength to accomplish the radial positioning of the focal spot. An additional tradeoff is made as well between electron deflection and distribution of the electrons on the target. Because of the severe bending that the electrons go through and the non-linear nature of the deflection mechanism, the electrons may be non-uniformly distributed on the target, thus causing the resulting focal spot to be non-uniform as well.

It would therefore be desirable to design a rotating frame x-ray tube providing dramatically improved bearing life, having a cathode at a fixed radial position with respect to a CT gantry and without having the aforementioned drawbacks of excessive field strength requirements, limited radial deflection capability of the electron beam, excess viscous drag, and non-uniform spot shapes emitting from the target.

BRIEF DESCRIPTION OF THE INVENTION

The present invention is directed to a method of fabricating and an apparatus of a rotating frame x-ray tube having a stationary cathode radially offset from a center of rotation thereof, and having a target and cathode hermetically sealed from an ambient environment.

According to one aspect of the present invention includes an x-ray tube having a stationary base and a passage therein. The x-ray tube includes an anode frame having an anode positioned adjacent to a first end and having a neck at a second end, the neck extends into the passage, wherein the anode frame is configured to rotate about a longitudinal axis of the passage. A hermetic seal is positioned about the neck between the neck and the stationary base.

In accordance with another aspect of the invention, a method of fabricating an x-ray tube includes providing a stationary base having a hole therein, providing a rotatable frame having a neck extending therefrom, inserting the neck of the rotatable frame into the hole of the stationary base, and positioning a ferrofluid seal between the stationary base and the neck.

Yet another aspect of the present invention includes a CT system including a rotatable gantry having an opening to receive an object to be scanned and a detector positioned to receive x-rays passing through the object. The CT system includes a rotatable frame x-ray tube configured to project x-rays toward the subject. The rotatable frame x-ray tube includes a mount attached to the rotatable gantry, the mount having a passageway therein. The rotatable frame x-ray tube includes a rotatable frame having a cylindrical extension extending therefrom and into the passageway, the rotatable frame containing a vacuum therein. A hermetic seal is positioned between the cylindrical extension and the mount allowing relative motion therebetween.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention is described with respect to the use of an x-ray tube as used in a computed tomography (CT) system. However, it will be appreciated by those skilled in the art that the present invention is equally applicable for use in other systems that require the use of an x-ray tube. Such uses include, but are not limited to, x-ray imaging systems (for medical and non-medical use), mammography imaging systems, and radiographic (RAD) systems.

Moreover, the present invention will be described with respect to use in an x-ray tube. However, one skilled in the art will further appreciate that the present invention is equally applicable for other systems that require operation of a bearing in a high vacuum, high temperature, and high contact stress environment, wherein the life, reliability, or performance of the x-ray tube could benefit from placement of a bearing outside the vacuum region of the x-ray tube. The present invention will be described with respect to a "third generation" CT medical imaging scanner, but is equally applicable with other CT systems, such as a baggage scanner or a scanner for other non-destructive industrial uses.

Figure 1:
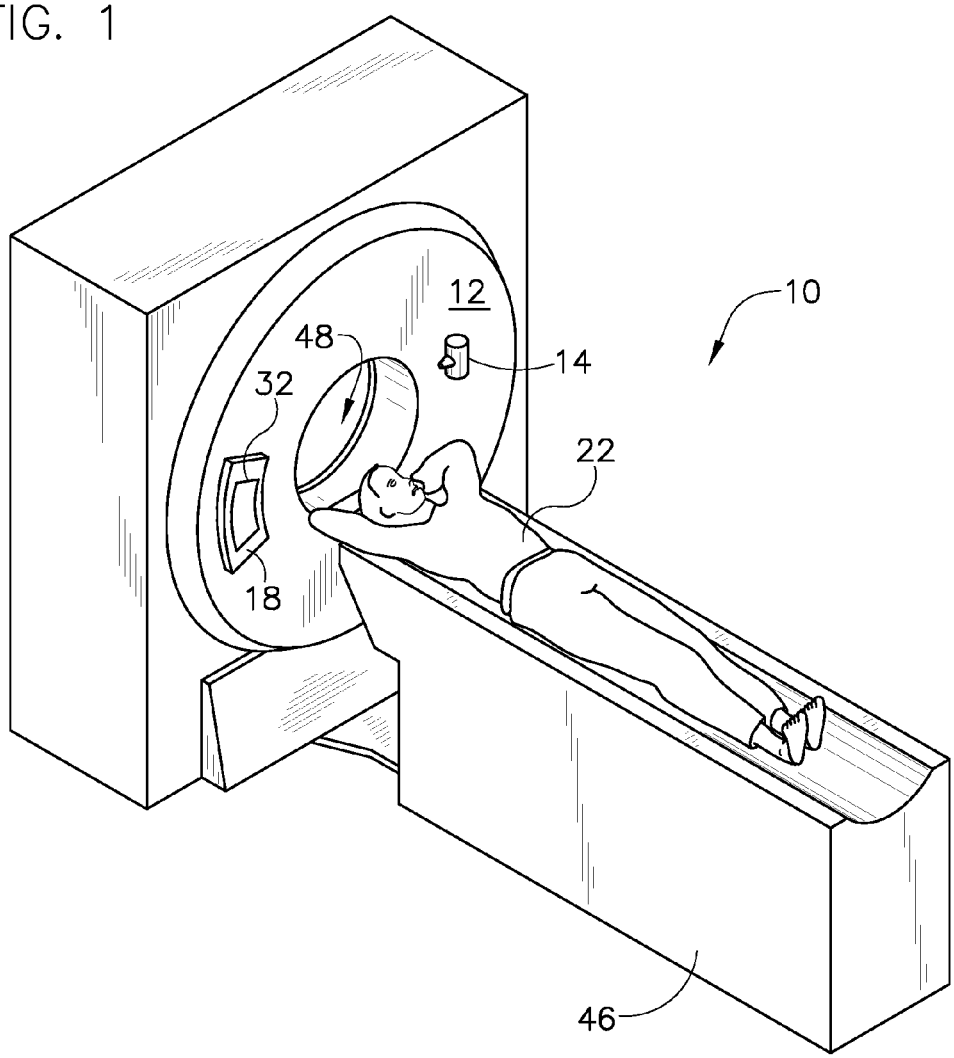
FIG. 1 is a pictorial view of an embodiment of a CT imaging system of the current invention.
Figure 2:
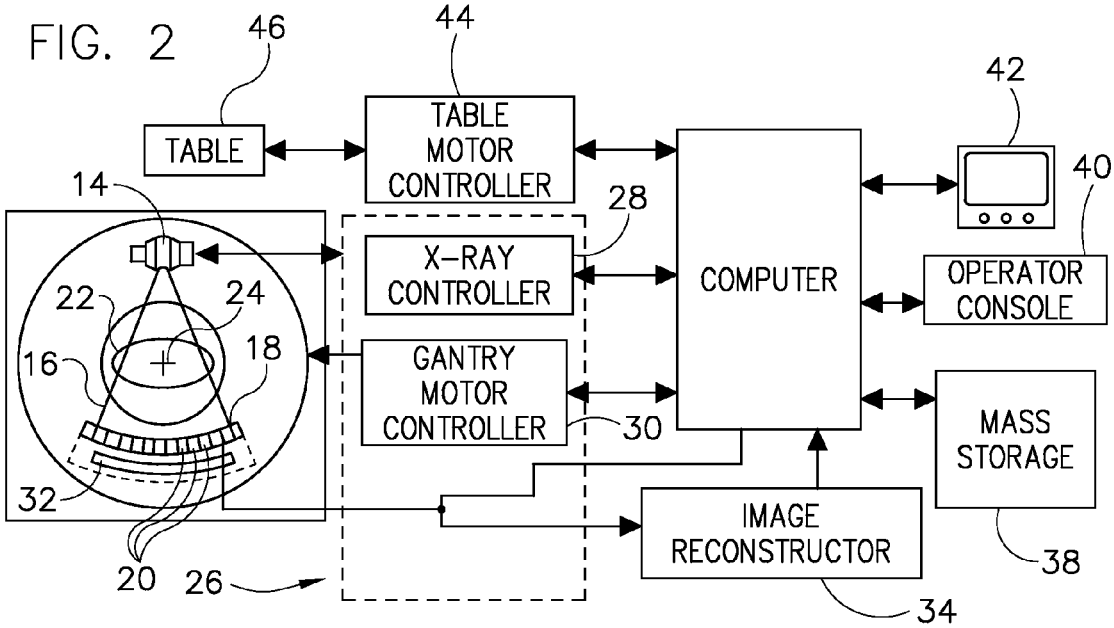
FIG. 2 is a block schematic diagram of the system illustrated in FIG. 1.

Referring to FIG. 1, a computed tomography (CT) imaging system 10 is shown as including a gantry 12 representative of a "third generation" CT scanner. Gantry 12 has an x-ray source 14 that projects a beam of x-rays 16 toward a detector assembly or collimator 18 on the opposite side of the gantry 12. Referring now to FIG. 2, detector assembly 18 is formed by a plurality of detectors 20 and data acquisition systems (DAS) 32. The plurality of detectors 20 sense the projected x-rays that pass through a medical patient 22, and DAS 32 converts the data to digital signals for subsequent processing. Each detector 20 produces an analog electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves patients 22 through a gantry opening 48 of FIG. 1 in whole or in part.

Figure 3:
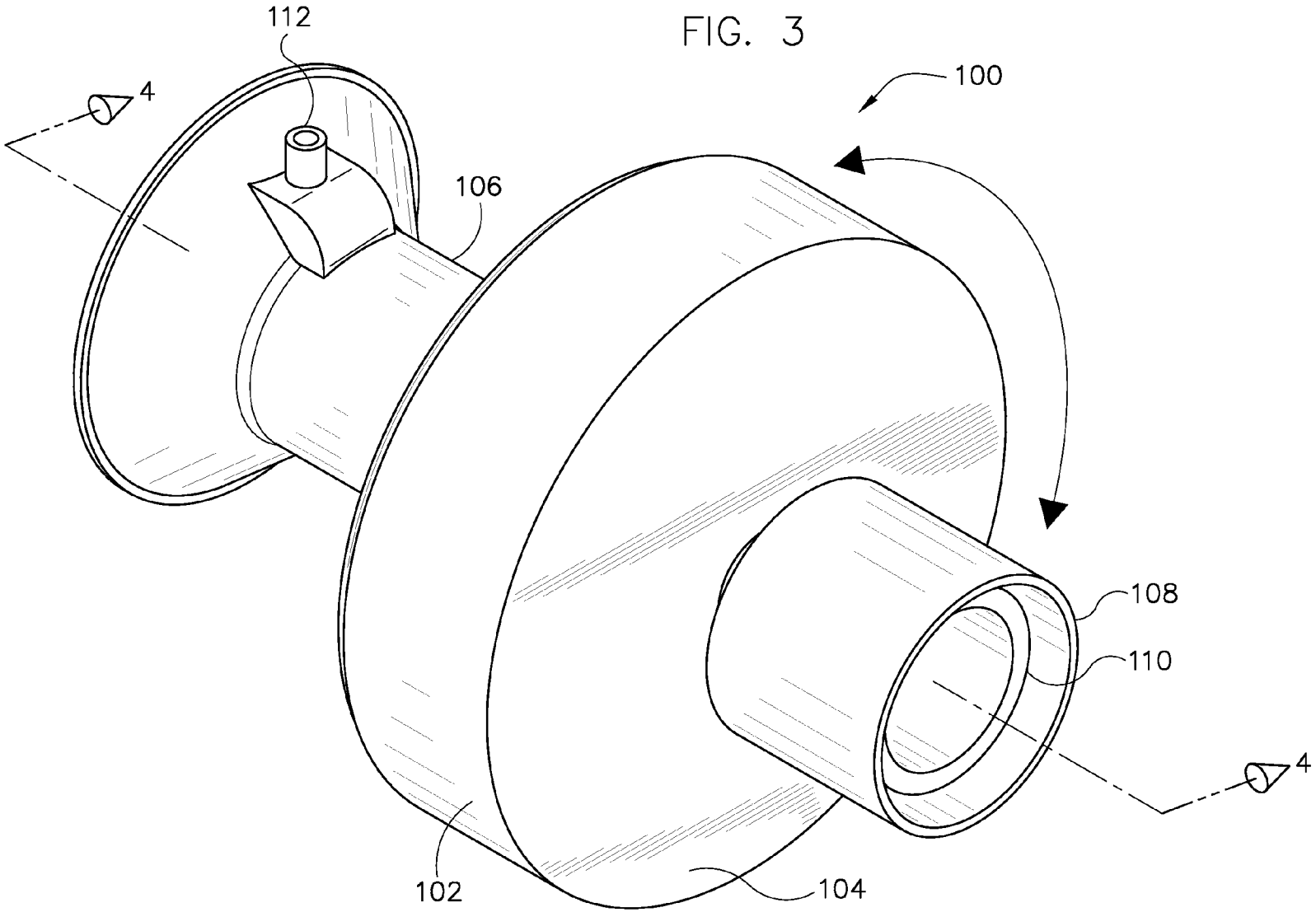
FIG. 3 is a perspective view of a rotatable frame x-ray tube according to an embodiment of the present invention.

Referring to FIG. 3, a rotatable frame x-ray tube 100 includes a rotatable anode frame 102 having a target 104 attached thereto according to an embodiment of the present invention. A rotor 110 is positioned within a stationary housing 108 and is attached to the target 104. Rotatable anode frame 102 is supported by stationary base 106 and rotor 110. Stationary base 106 is typically fabricated of an insulating material including alumina and the like. The stationary mount or base 106 of the rotatable frame x-ray tube 100, in one example, is attached to a rotatable base of a CT system. The stationary base 106, although illustrated at a substantially flat or "pancake" insulator, one skilled in the art will recognize that stationary base 106 may likewise be a cylindrical insulator or may take on other design shapes. An access port 112 formed in stationary base 116 allows access to an internal volume (shown in FIG. 4) of x-ray tube 100.

Figure 4:
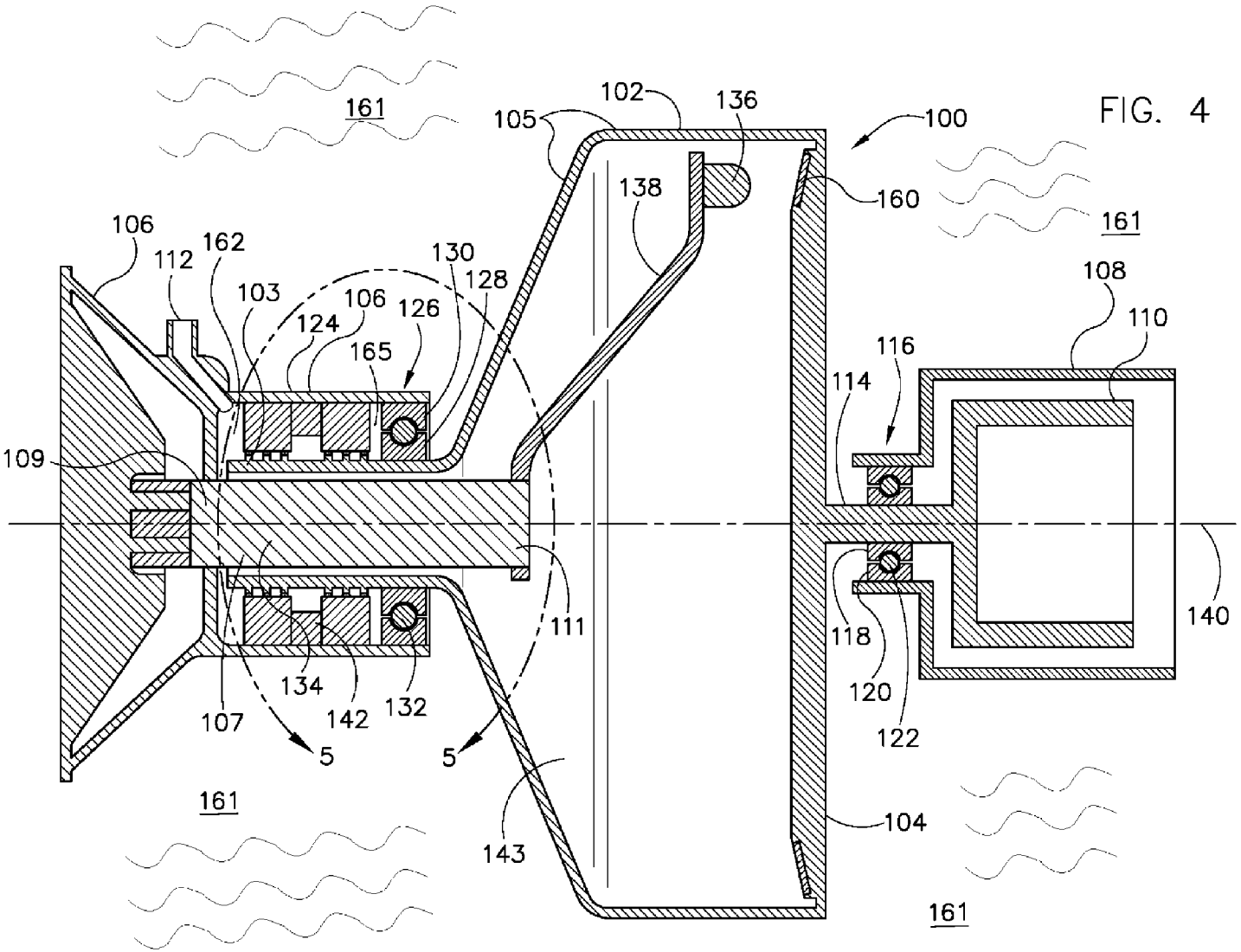
FIG. 4 is a cross-sectional view of the rotatable frame x-ray tube of FIG. 5 according to an embodiment of the present invention.

FIG. 4 shows a cross-section of x-ray tube 100 of FIG. 3 taken along line 4-4. Rotatable frame 102 has a bell portion 105 and a neck portion 103. Target 104 is attached to or integrally formed with bell portion 105. A support shaft 114 connects target 104 to rotor 110. Support shaft 114 is supported by a bearing assembly 116 attached to housing 108. Bearing assembly 116 includes an inner bearing race 118, an outer bearing race 120, and a row of bearing balls 122 positioned therebetween.

Neck 103 extends into a passage 107 formed within a neck 124 of stationary base 106. Neck 103 is supported by a bearing assembly 126 positioned between neck 124 of stationary base 106 and neck 103 of rotatable frame 102. Bearing assembly 126 includes an inner race 128 and an outer race 130 having balls 132 positioned therebetween. Rotatable frame 102, supported by bearing assemblies 116, 126, rotates about a longitudinal or rotational axis 140. Bearing assemblies 116, 126 may include wet-lubricated bearings using lubrications such as grease, oil, and the like.

A hermetic seal assembly 142 such as a ferrofluid seal (FFS) assembly is positioned between neck 124 and neck 103 of rotatable frame 102. As described below with regard to FIG. 5, hermetic seal assembly 142 allows rotation of rotatable frame 102 while minimizing gas, liquid, and other molecular contamination in an internal volume 143 of x-ray tube 100. The hermetic seal assembly 142 is positioned between a vacuum region 162 and an ambient pressure region 165, and the vacuum region 162 is fluidically coupled to the internal volume 143 having high vacuum therein. Accordingly, the hermetic seal assembly 142 is designed to withstand a pressure differential between high vacuum and, typically, ambient pressure. An access port 112 allows access to vacuum region 162 of x-ray tube 100. In one embodiment of the present invention, an ion pump, a getter, a turbo pump, or the like fluidically connects to access port 112 for interception of molecular contaminants passing through the hermetic seal assembly 142 or emitting therefrom, to vacuum region 162, and into internal volume 143, which is typically maintained at a high-vacuum. A feedthrough 134 is attached to stationary base 106 at one end 109 of feedthrough 134, and a cathode extension 138 is attached to another end 111 of feedthrough 134. A cathode 136 is attached to the cathode extension 138 and extends toward a target track 160 attached to target 104. One skilled in the art will recognize that feedthrough 134, although shown as a solid object, may likewise include a hollow or open design passing therethrough which allows passage of high voltage leads from the stationary base 106 to cathode 136.

Figure 5:
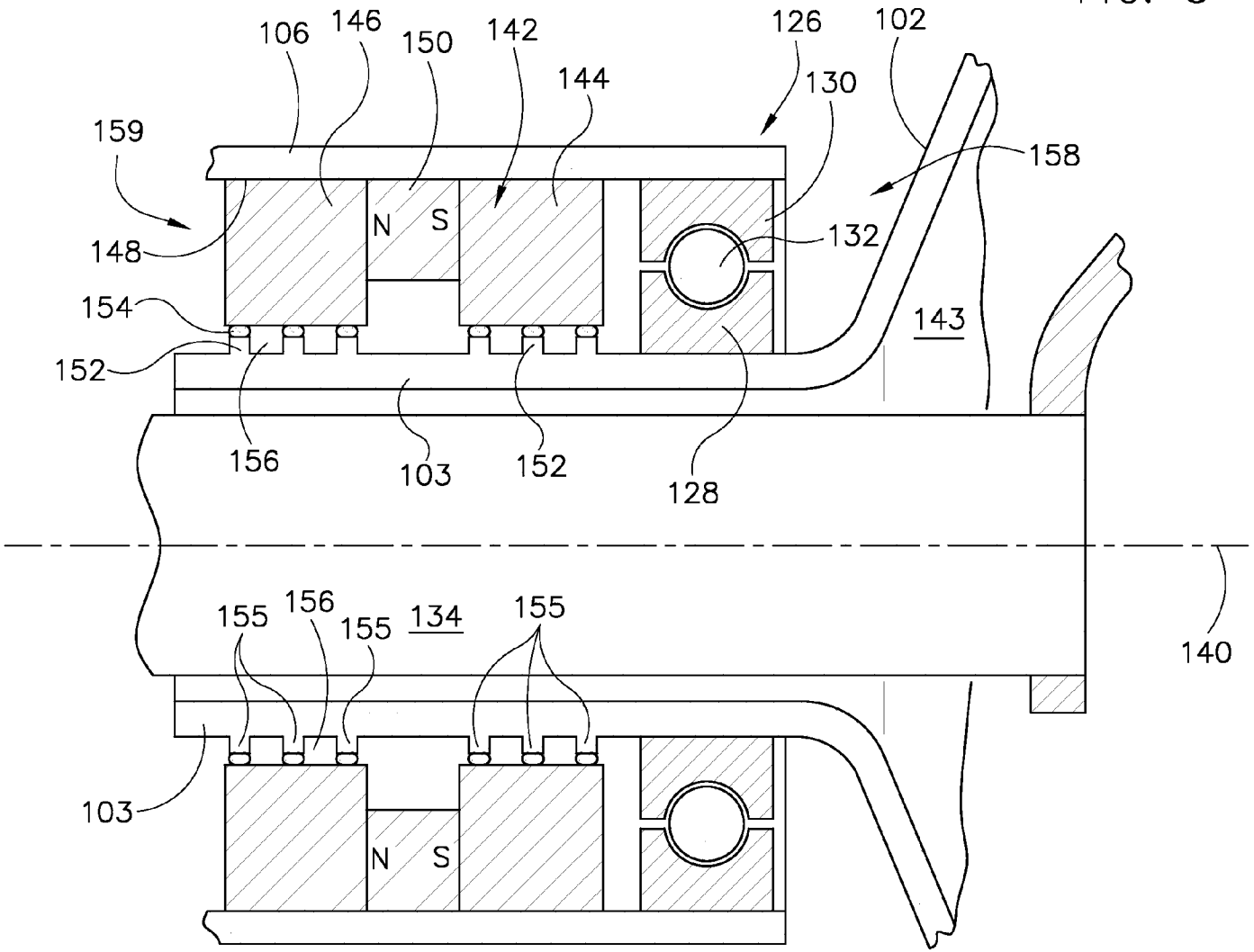
FIG. 5 is a cross-sectional view of a ferrofluid assembly according to an embodiment of the present invention.

FIG. 5 illustrates a cross-sectional view of a hermetic seal assembly taken along Line 5-5 of FIG. 4. In one embodiment of the present invention, hermetic seal assembly 142 is a ferrofluid seal assembly that includes a longitudinal series of seal stages 155 between a rotating component, such as rotatable frame 102, and a non-rotating component, such as stationary base 106. The seal stages 155 include a ferrofluid 154 that is typically a hydrocarbon-based or fluorocarbon-based oil with a suspension of magnetic particles therein. The particles are coated with a stabilizing agent, or surfactant, which prevents agglomeration of the particles in the presence of a magnetic field. When in the presence of a magnetic field, the ferrofluid 154 forms a seal stage 155. The seal stage 155 can withstand pressure of typically 1-3 psi and, when each stage 155 is placed in series, the overall ferrofluid seal assembly can withstand pressure varying from atmospheric pressure on one side to high vacuum on the other side.

Referring still to FIG. 5, a pair of annular pole pieces 144, 146 abut an interior surface 148 of neck 124 and encircle neck 103. An annular permanent magnet 150 is positioned between pole piece 144 and pole piece 146. In a preferred embodiment, neck 103 includes annular rings 152 extending therefrom toward pole pieces 144, 146. Alternatively, however, pole pieces 144, 146 may include annular rings extending toward neck 103 instead of, or in addition to, annular rings 152 of neck 103. A ferrofluid 154 is positioned between each annular ring 152 and corresponding pole piece 144, 146, thereby forming cavities 156. Magnetization from permanent magnet 150 retains the ferrofluid 154 positioned between each annular ring 152 and corresponding pole piece 144, 146 in place. In this manner, multiple stages 155 of ferrofluid 154 are formed that hermetically seal the pressure of gas on an ambient pressure side 158 of ferrofluid seal assembly 142 from a non-ambient pressure side 159 of ferrofluid seal assembly 142 exposed, typically, to a high vacuum formed in the internal volume 143 of x-ray tube 100. As shown, FIG. 5 illustrates six seal stages 155. Each stage 155 typically withstands 1-3 psi of gas pressure. Accordingly, one skilled in the art will recognize that the number of seal stages 155 may be increased or decreased, depending on the difference in pressure between the ambient pressure side 158 and the non-ambient pressure side 159. According to one embodiment of the present invention, a coolant may be fed or otherwise directed to pole pieces 144, 146 through a coolant line (not shown) to cool a temperature of ferrofluid 154.

Referring again to FIG. 4, the rotatable frame 102 encloses a high vacuum within internal volume 143 which is separated from the ambient environment 158 by the ferrofluid 154. The x-ray tube 100 is typically immersed in a liquid coolant 161 and heat generated at the track 160 is convectively cooled by the liquid coolant 161. Accordingly, the bearing assemblies 116, 126 likewise are immersed in the liquid coolant 161 which may act, according to an embodiment of the present invention, as a liquid lubricant therefore. According to another embodiment of the present invention, the bearing assemblies 116, 126 may be sealed from the liquid coolant 161 by use of bearing seals positioned therein. Stationary base 106 includes access port 112 having an ion pump, a getter, or a turbo pump. As such, region 162 of FIG. 4 is maintained at high vacuum and gases emitting from the ferrofluid may be intercepted and removed via the access port 112.

In operation, the target 104 is caused to rotate about rotational axis 140 by a stator (not shown), that applies a force to rotor 110, causing the shaft 114, target 104, and rotatable frame 102 to rotate. Because the cathode 136 is fixed and positioned radially off-center from the rotational axis 140, it emits electrons toward the target 104 such that the electrons impinge on the target track 160 as the target 104 rotates. The cathode 136 is attached to the feedthrough 134 such that electrons emitting therefrom are directed toward the object to be imaged as the x-ray tube 100 is rotated about the object on a gantry 12 of FIGS. 1 and 2. In a preferred embodiment, x-ray tube 100 is immersed in a coolant 161 that removes heat conducted through target 104 and heat that is radiated from the target 104 within internal volume 143 to rotatable frame 102. Because stationary base 106 and neck 124 are stationary components, viscous drag of the rotating frame 102 is reduced when compared to a conventional rotating frame design, due to the reduced surface area of the rotating components. Effluent emitting from the bearing assembly 126 or passing therethrough are largely precluded from entering high vacuum region 162 and ultimately the internal volume 143, due to the presence of the ferrofluid 154. Furthermore, such effluent passing through the ferrofluid 154 or emitting therefrom may be intercepted in the high vacuum region 162 by operation of an ion pump, getter, or turbo pump fluidically connected to the high vacuum region 162 through access port 112.

Figure 6:
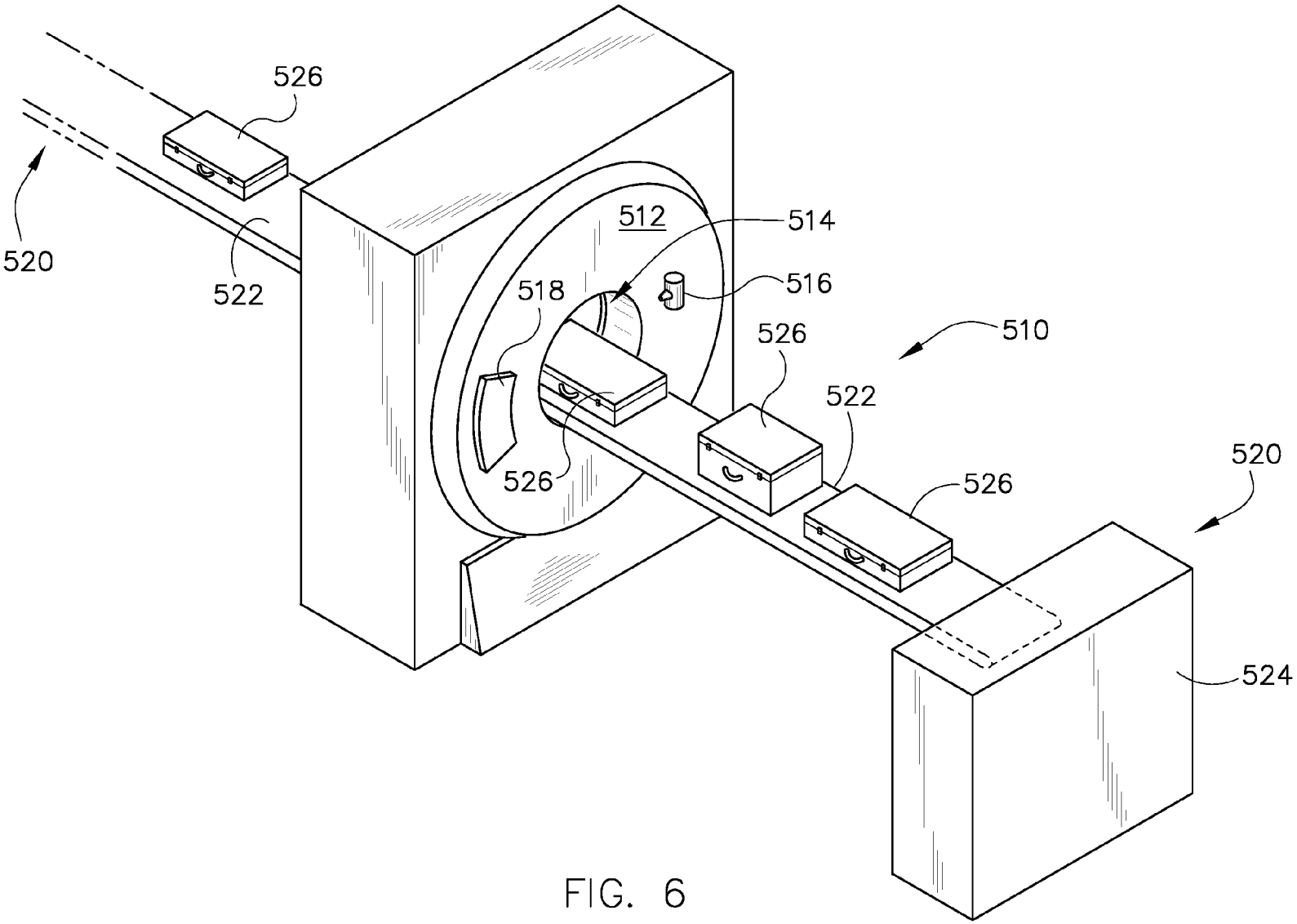
FIG. 6 is a pictorial view of a CT system for use with a non-invasive package inspection system.

Referring now to FIG. 6, package/baggage inspection system 510 includes a rotatable gantry 512 having an opening 514 therein through which packages or pieces of baggage may pass. The rotatable gantry 512 houses a high frequency electromagnetic energy source 516 according to an embodiment of the present invention, as well as a detector assembly 518 having scintillator arrays comprised of scintillator cells. A conveyor system 520 is also provided and includes a conveyor belt 522 supported by structure 524 to automatically and continuously pass packages or baggage pieces 526 through opening 514 to be scanned. Objects 526 are fed through opening 514 by conveyor belt 522, imaging data is then acquired, and the conveyor belt 522 removes the packages 526 from opening 514 in a controlled and continuous manner. As a result, postal inspectors, baggage handlers, and other security personnel may non-invasively inspect the contents of packages 526 for explosives, knives, guns, contraband, etc. Additionally, such systems may be used in industrial applications for non-destructive evaluation of parts and assemblies.

According to one embodiment of the present invention, an x-ray tube includes an x-ray tube having a stationary base and a passage therein. The x-ray tube includes an anode frame having an anode positioned adjacent to a first end and having a neck at a second end, the neck extends into the passage, wherein the anode frame is configured to rotate about a longitudinal axis of the passage. A hermetic seal is positioned about the neck between the neck and the stationary base.

In accordance with another embodiment of the present invention, a method of fabricating an x-ray tube includes providing a stationary base having a hole therein, providing a rotatable frame having a neck extending therefrom, inserting the neck of the rotatable frame into the hole of the stationary base, and positioning a ferrofluid seal between the stationary base and the neck.

Yet another embodiment of the present invention includes a CT system including a rotatable gantry having an opening to receive an object to be scanned and a detector positioned to receive x-rays passing through the object. The CT system includes a rotatable frame x-ray tube configured to project x-rays toward the subject. The rotatable frame x-ray tube includes a mount attached to the rotatable gantry, the mount having a passageway therein. The rotatable frame x-ray tube includes a rotatable frame having a cylindrical extension extending therefrom and into the passageway, the rotatable frame containing a vacuum therein. A hermetic seal is positioned between the cylindrical extension and the mount allowing relative motion therebetween.

The present invention has been described in terms of the preferred embodiment, and it is recognized that equivalents, alternatives, and modifications, aside from those expressly stated, are possible and within the scope of the appending claims.

What is claimed is:

1. An x-ray tube comprising:

a stationary base having a passage therein;

an anode frame configured to contain a vacuum, the anode frame having a target positioned adjacent to a first end and having a neck at a second end, the neck extending into the passage, wherein the anode frame is configured to rotate about a longitudinal axis of the passage; and a hermetic seal positioned about the neck between the neck and the stationary base.

2. The x-ray tube of claim 1 further comprising a first wet-lubricated bearing positioned between the neck and the stationary base.

3. The x-ray tube of claim 1 further comprising:

a feedthrough extending from the stationary base, through the neck, and into the anode frame; and a cathode attached to the feedthrough and enclosed within the anode frame.

4. The x-ray tube of claim 3 wherein the target is attached to the anode frame and positioned to receive electrons emitted from the cathode.

5. The x-ray tube of claim 4 wherein the cathode is positioned opposing the target at a radial position off-center from the longitudinal axis.

6. The x-ray tube of claim 1 further comprising a support shaft attached to the target.

7. The x-ray tube of claim 6 further comprising a wet-lubricated bearing configured to support the support shaft.

8. The x-ray tube of claim 6 further comprising a rotor attached to the support shaft.

9. The x-ray tube of claim 1 wherein the stationary base is attached to an imaging system comprising one of a CT system, an x-ray system, a RAD scanner, and a mammography scanner.

10. The x-ray tube of claim 1 further comprising a liquid coolant in thermal contact with the target.

11. The x-ray tube of claim 1 wherein the hermetic seal comprises a ferrofluid seal.

12. The x-ray tube of claim 1 further comprising one of an ion pump, a getter, and a turbo pump access port positioned between the hermetic seal and the contained vacuum.

13. A method of fabricating an x-ray tube, the method comprising:

providing a stationary base having a hole therein;

providing a rotatable frame having a cathode positioned therein and having a neck extending therefrom;

inserting the neck of the rotatable frame into the hole of the stationary base; and positioning a ferrofluid seal between the stationary base and the neck.

14. The method of claim 13 further comprising:

attaching the cathode to the stationary base; and attaching a target to the rotatable frame.

15. The method of claim 14 further comprising cooling the target with a liquid.

16. The method of claim 13 further comprising positioning one of an ion pump, a getter, and a turbo pump access port on the stationary base between the ferrofluid seal and an enclosed vacuum within the rotatable frame.

17. The method of claim 13 wherein providing the rotatable frame comprises providing the rotatable frame having a longitudinal axis about which the rotatable frame is rotatable relative to the cathode.

18. The method of claim 13 further comprising supporting the rotatable frame with a pair of bearings.

19. The method of claim 18 wherein the step of supporting the rotatable frame further comprises positioning one of the pair of bearings between the stationary base and the neck.

20. An imaging system comprising:

a detector positioned to receive x-rays passing through a subject; and a rotatable frame x-ray tube configured to project x-rays toward the subject, the rotatable frame x-ray tube comprising:

a mount attached to a rotatable gantry, the mount having a passageway therein;

a rotatable frame having a cylindrical extension extending therefrom and into the passageway, the rotatable frame containing a vacuum therein; and a hermetic seal positioned between the cylindrical extension and the mount allowing relative motion therebetween.

21. The imaging system of claim 20 wherein the hermetic seal is a ferrofluid seal.

22. The imaging system of claim 20 wherein the rotatable frame x-ray tube further comprises:

a cathode attached to the mount and positioned within the vacuum; and a target attached to the rotatable frame.

23. The imaging system of claim 22 wherein the target is cooled by a liquid.

24. The imaging system of claim 20 further comprising one of an ion pump, a getter, and a turbo pump access port positioned between the hermetic seal and the vacuum.

25. The imaging system of claim 20 wherein the imaging system comprises one of a CT imaging system, an x-ray system, a mammography system, and a RAD system.

* * * * *